US007213718B2

(12) United States Patent
Ring

(10) Patent No.: US 7,213,718 B2
(45) Date of Patent: May 8, 2007

(54) VERTICALLY ALIGNING SLACKLESS DRAWBAR

(75) Inventor: Michael E. Ring, Saint John, IN (US)

(73) Assignee: Wabtec Holding Corp., Wilmerding, PA (US)

( * ) Notice: Subject to any disclaimer, the term of this patent is extended or adjusted under 35 U.S.C. 154(b) by 182 days.

(21) Appl. No.: 10/971,656

(22) Filed: Oct. 22, 2004

(65) Prior Publication Data

US 2006/0086686 A1 Apr. 27, 2006

(51) Int. Cl.
*B61G 9/00* (2006.01)

(52) U.S. Cl. ..... 213/62 R

(58) Field of Classification Search ..... 213/62 R, 213/63, 64, 67 R, 69, 72
See application file for complete search history.

(56) References Cited

U.S. PATENT DOCUMENTS 4,552,377 A * 11/1985 Folkerts ..... 280/515

5,131,548 A * 7/1992 Chi ..... 213/64

* cited by examiner

*Primary Examiner*—S. Joseph Morano
*Assistant Examiner*—Robert J. McCarry, Jr.
(74) *Attorney, Agent, or Firm*—James Ray & Assoc.

(57) ABSTRACT

A vertically aligning slackless drawbar for connecting adjacently disposed ends of a pair of railway freight cars together in a substantially semi-permanent manner. Such vertically aligning slackless drawbar comprises a first member and a second member pivotably and slideably coupled to each other with a pivot pin, preventing lifting of the body of such railway freight car from the bolster in a light aluminum railway freight car application. A predetermined clearance is designed between the adjacent ends of the first and second member to limit lateral movement of the second member in relationship to the first member in order to limit occurrence of jackknifing. The first member is secured to a yoke with the standard "F" pin. The yoke is further secured between the rear lug and a front lug of a center sill of a railway freight car. A pair of tapered gravity wedges compensate for longitudinal slack and are held in place with a pair of leaf springs disposed between the rear lug and said gravity wedge.

15 Claims, 1 Drawing Sheet

VERTICALLY ALIGNING SLACKLESS DRAWBAR

FIELD OF THE INVENTION

The present invention relates, in general, to certain selected railway type freight car coupling arrangements of the substantially semi-permanent type which are being utilized rather extensively at the present time in the railroad industry to connect the adjacently disposed ends of a pair of such freight cars together in a train consist and, more particularly, the instant invention relates to an improved type of slackless drawbar assembly having vertical aligning means and, still more particularly, this invention relates to an improved vertically aligning slackless drawbar assembly offering a cost effective method of gravity wedge retainment.

BACKGROUND OF THE INVENTION

Articulated coupling arrangements used for the purpose of connecting adjacently disposed ends of a pair of railway freight cars together in a substantially semi-permanent fashion are well know in the art of railway freight vehicles. These articulated coupling arrangements have to accommodate the longitudinal travel in both directions, as well as the vertical and lateral travel at the coupling as the railway freight cars progress along the rails. The greater loads carried by modern railway cars necessitated articulated coupling arrangements which are capable of maintaining a close-butted relationship between various components to lessen the impact forces on railway cars and the articulated coupling arrangements. As a result, closed buttoned relationships lead to the development of slackless articulated coupling arrangements primarily consisting of couplers and drawbars. The term slackless means that the coupler or drawbar of a particular design is disposed within the center sill in a manner which minimizes longitudinal play or movement.

The main advantage of the coupler generally used with the draft gear assembly is that it accommodates the longitudinal travel in both directions, as well as the vertical and lateral travel at the coupling as the railway freight cars progress along the track and, more particularly, enabling such cars to more easily negotiate the curved portion of the track which will be encountered during operation. The primary disadvantage of the coupler is the play or slack in a longitudinal direction increasing the load forces onto a railway freight car. An additional disadvantage of the coupler and the draft gear assembly is the high unit costs due to the complexity of the design and a requirement for a significant number of the components.

Lately, the slackless drawbar assemblies have all but eliminated the need for a relatively expensive draft gear assembly used with coupler arrangements. Furthermore, these slackless drawbar assemblies have generally resulted in a desirable overall net decrease in the empty weight of such railway freight cars as well as in overall decrease in unit cost.

Each of the slackless drawbar assemblies which are known to be in use at the present time, however, suffer from at least one important and common disadvantage. This common disadvantage is that these slackless drawbar assemblies do not accommodate vertical and lateral travel at the coupling as the railway freight cars progress along the rails and, more particularly, while curving, thus increasing possibility of a flange climb derailment.

Additionally, the slackless drawbar may be employed to connect adjacently disposed ends of a pair of a railway freight cars with one car having worn wheels while the other cars have new wheels. Given this condition, the slackless drawbar will then be disposed at an angle in the vertical plane creating an additional vertical force onto a railway freight car having new wheels. This problem is especially magnified when the slackless drawbar is employed to connect adjacently disposed ends of a pair of aluminum lightweight construction coal carrying railway freight cars or an empty weight car. In this application, the slackless drawbar disposed at the angle in a vertical plane may cause the separation of the freight car body from the bolster or it may even cause lifting of the entire fright car from the rail.

As of particular significance is a reduction of frictional resistance to side loads to reduce side movement of the connecting adjacently disposed ends of a pair of railway cars and, more importantly, to reduce wheel and rail wear resulting from such side movement and to further minimize the possibility of a flange climb derailment.

As it can be seen from the above discussion it is desirable to employ a slackless drawbar which allows for vertical and lateral movement.

A common method of providing a slackless arrangement is to utilize a tapered gravity type wedge between a rear wall of a pocket casting (secured in the center sill) and a follower block which rests against the butt end of the coupler or drawbar member. The gravity wedge tends to force the follower block away from the pocket casting end wall and firmly against the butt end of the coupler or drawbar member shank. When component wear occurs subsequently increasing longitudinal clearances between the follower block and the coupler or drawbar member, the clearance or the slack is constantly being taken up by the action of the dropping gravity wedge.

In railway freight cars being pushed (buff), the longitudinal forces cause compression of the slackless coupler or drawbar member against the follower, gravity wedge and pocket end wall of the slackless arrangement.

When cars are being pulled (draft), the longitudinal forces tending to separate the slackless drawbar or coupler from the pocket end wall creating a condition where the gravity wedge can descend under gravity and lock when the railway freight cars are under the buff load.

With the above discussion in mind, attention is now directed to a particular prior art type gravity wedge for a slackless railcar connector assembly. This prior art gravity wedge is taught in U.S. Pat. No. 5,573,126. Disclosed therein is a tapered gravity wedge having a resilient means comprised of an elastomeric or a conventional compression spring disposed within a close tolerance machined bore on one or both faces of the gravity wedge and which protrudes slightly beyond one or both faces of the gravity wedge so that a small, but controlled gap symmetrically remains between the gravity wedge face(s) and the adjacent surface(s). When railcar buff loads are released, the only locked-in force operating on the connector assembly will be that dictated by the compressive load rate of the resilient means. When the buff or compressive load has been released, the gravity wedge will maintain its vertical position as the resilient means "feeds out" and holds the gravity wedge in place, until the next-experienced tensile loading.

One of the disadvantages of the gravity wedge of the prior art is the increased cost of the close tolerance machined bores. The other disadvantage is the impact of the environmental factors, such as temperature, humidity, dust and moisture affecting the structural integrity and operation of the resilient means thus enabling descend of the gravity wedge under a draft load condition.

Therefore, it is desirable to improve upon retainment of the gravity wedge.

SUMMARY OF THE INVENTION

The present invention provides a vertically aligning slackless drawbar for connecting adjacently disposed ends of a pair of railway freight cars together in a substantially semi-permanent manner. Such vertically aligning slackless drawbar includes a first member and a second member pivotably and slideably coupled to the first member at one end with a pivot pin. The connection enables vertical movement of the second member in relationship to the first member, thus maintaining such vertically aligning slackless drawbar in a substantially lateral plane and further preventing lifting of the body of such railway freight car from the bolster in a light aluminum railway freight car application. The first member is further secured to a yoke at the other end with the standard "F" pin, and the yoke is secured between the rear lug and a front lug of a center sill of a railway freight car. A pair of tapered gravity wedges compensate for longitudinal slack and are held in place with a pair of leaf springs disposed between the rear lug and the gravity wedge. A predetermined clearance is designed between the adjacent ends of the first and second member to limit lateral movement of the second member in relationship to the first member in order to minimize occurrence of jackknifing. The distal ends of the first and second member incorporate substantially convex surfaces to permit the vertically aligning slackless drawbar and to permit the car to roll with respect to the vertically aligning slackless drawbar.

OBJECTS OF THE INVENTION

It is an object of the present invention to provide a vertically aligning slackless drawbar that prevents disengagement of the car body with the bolster in a light railway freight car application.

It is a further object of the present invention to provide a vertically aligning slackless drawbar that minimizes the occurrence of a flange climb derailment in light weight freight cars.

It is another object of the invention to provide a vertically aligning slackless drawbar that offers a lower cost alternative to a slackless coupler in a light railway freight car application.

It is an additional object of the invention to provide a vertically aligning slackless drawbar that contains an improved gravity wedge retainment.

Although a number of objects and advantages of the present invention have been described in some detail above, various additional objects and advantages of the vertically aligning slackless drawbar of the present invention will become more readily apparent to those persons who are skilled in the art from the following more detailed description of the invention, particularly when such detailed description of the invention is taken in conjunction with both the attached drawing figures and with the appended claims.

DETAILED DESCRIPTION OF VARIOUS EMBODIMENTS OF THE INVENTION

Figure 3:
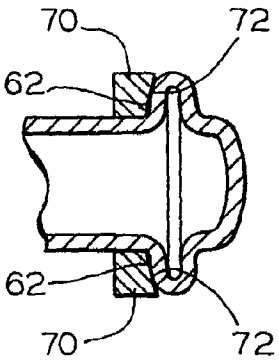
FIG. 3 is a partial planar cross-sectional view of the second member of the vertically aligning slackless drawbar taken along lines 3—3 in FIG. 1.

Prior to proceeding with the more detailed description of the invention it should be noted that for the sake of clarity and understanding the invention, identical components which have identical functions have been identified with identical reference numerals throughout the several views illustrated in the attached drawing Figures.

Now reference is made, more particularly, to the several Figures. Illustrated therein is an vertically aligning slackless drawbar, generally designated 10, constructed according to a presently preferred embodiment of the invention. Such vertically aligning slackless drawbar 10 connects the adjacently disposed ends (not shown) of a pair of railway freight type cars (not shown) together in a substantially semi-permanent manner. Such vertically aligning slackless drawbar 10 comprises a first member, generally designated 20, coupled to a yoke, generally designated 110 and a second member, generally designated 50, pivotally coupled to the first member 20 with a pivot pin 14. The pin 14 is retained by a pair of fasteners 42 at each end.

As may be seen in the FIGURES, the first end of the first member 20 (partially shown) extends within an open end 102 of a first center sill, generally designated 100, of a standard construction which is secured longitudinally beneath a railway car (not shown).

Figure 1:
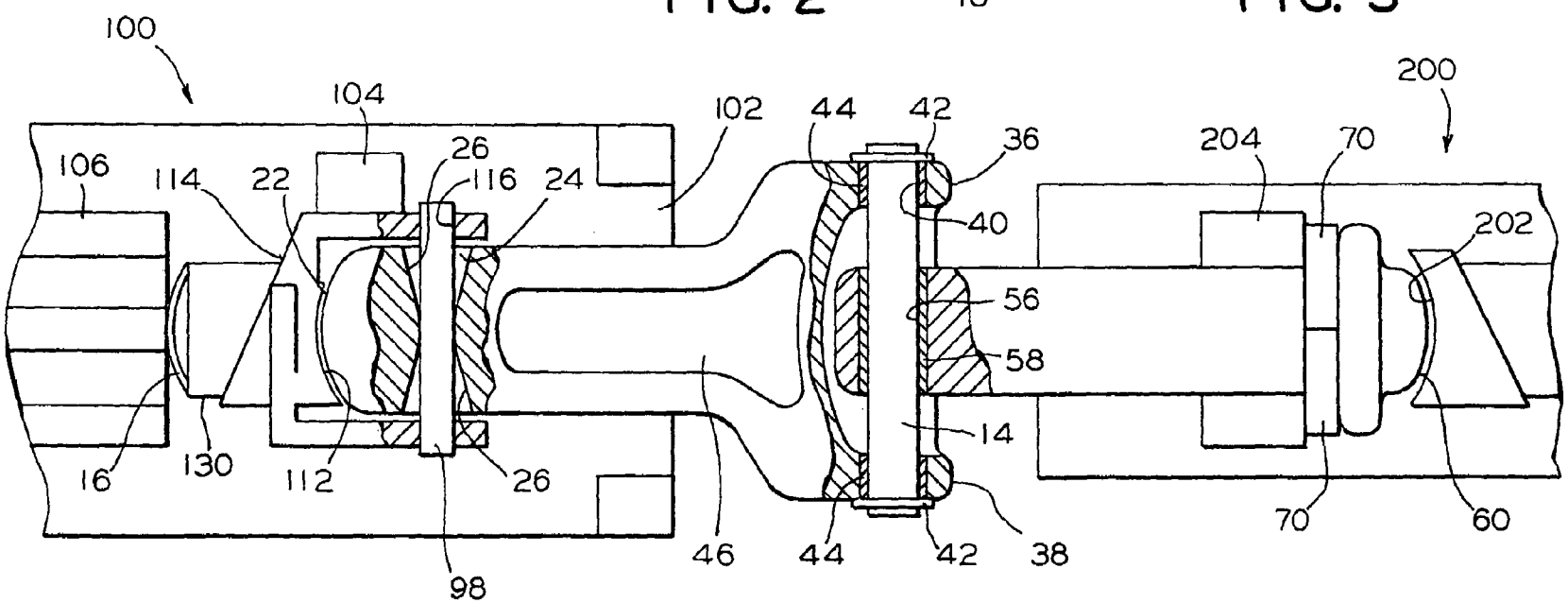
FIG. 1 is a partial planar elevation view of the vertically aligning slackless drawbar of the present invention, partially showing center sills of the adjacent railway freight cars.

The first end having a substantially convex surface 22 which fits against a matching substantially concave face 112 of the yoke 110 having a first end 120 and a second end 122 for retainment within the sill 100 between a front lug 104 and a rear lug 106. It is presently preferred that such substantially convex surface 22 will be convexly shaped in each of a generally lateral direction and a generally vertical direction. A vertically tapered gravity wedge 130 is located between the rear lug 106 of the first center sill 100 and a rear portion 114 of the yoke 110 to remove the longitudinal slack. The rear portion 114 has a first predetermined tapered profile as seen in FIG. 1, to cooperate with the second predetermined tapered profile of the gravity wedge 130. In the presently preferred embodiment, the second predetermined tapered profile of the gravity wedge 130 is substantially equal to the first predetermined tapered profile of such rear portion 114. First member 20 is secured within the yoke 110 by a standard "F" type pin 98 which is extended vertically through an "F" pin aperture 24 in the first member 20 and through a first pair of vertically aligned concentric apertures 116 disposed within the yoke 110. The aperture 24 includes a pair of wall surfaces 26 tapered toward the center of the first end at a predetermined angle to aid during such first member 20 rotation.

At least one leaf spring 16 of a predetermined force and of a predetermined temper is disposed between the rear lug 106 and the gravity wedge 130 to maintain such gravity wedge 130 in place and prevent the gravity wedge 130 from descending and locking in the draft condition. The advantage of such leaf spring 16 over prior art lies in its higher resiliency to the various environmental factors thus providing consistent retainment of such gravity wedge 130.

The second end of the first member 20 contains a cavity, generally designated 30, formed by a first side surface portion 32, a second side surface portion 34, a top surface portion 36 and bottom surface portion 38. Both the first side surface portion 32 and the second side surface portion 34 are sloped toward the center of the first member 20 at a predetermined angle. A second pair of vertically aligned concentric apertures 40 are provided within the top surface portion 36 and the bottom surface portion 38 for engagement with the pivot pin 14. Preferably a pair of sleeve bearings 44 are disposed within each of the second pair of apertures 40 for minimizing frictional forces during rotation of pivot pin 14.

In the alternative embodiment, coupling of the first member 20 to the second member 50 can be accomplished with a threaded fastener and, particularly, a shoulder screw type fastener. To enable this, one of the cavities 40 would be threaded to mate with a threaded portion of such shoulder screw. The shoulder screw type fastener can be either of a commercially available origin or a specialty fastener machined to predetermined dimensions as suitable for a particular application.

"Such first member 20 will preferably includes at least one weight-reducing aperture 46, having a predetermined configuration, formed therethrough intermediate its first and second ends".

Figure 2:
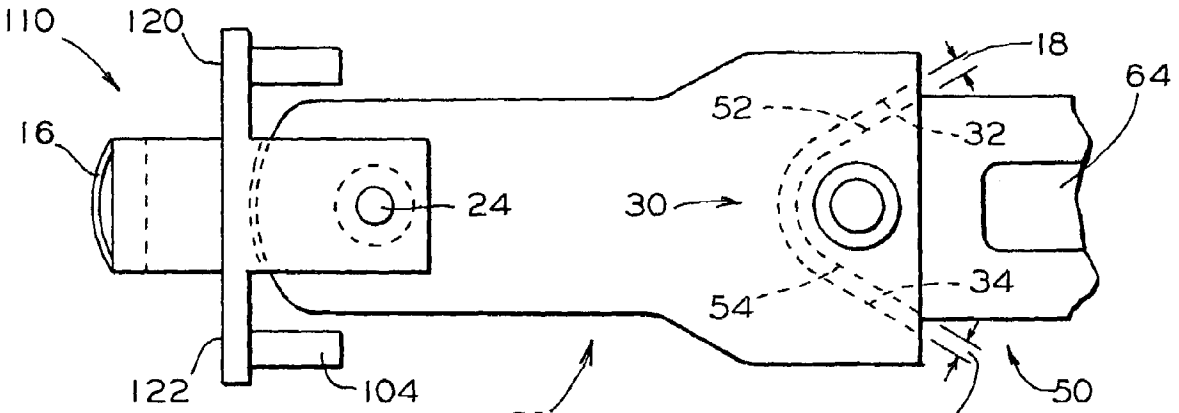
FIG. 2 is a partial planar lateral view of the vertically aligning slackless drawbar shown in FIG. 1.

The first end of the second member 50 contains a third tapered surface portion 52 and a fourth tapered surface portion 54 mating against the first side surface portion 32 and the second side surface portion 34 of the cavity 30, respectively. As can be seen in FIG. 2, a predetermined clearance 18 is designed between the first member 20 and the second member 50 to limit lateral motion of the second member 50 and minimize the occurrence of jackknifing of the railway freight cars.

Preferably, the first end of the second member 50 further contains a sleeve bearing 58 disposed within a pivot pin aperture 56 of a predetermined diameter for minimizing frictional forces during lateral rotation and vertical sliding movements of the pivot pin 14.

The second end of the second member 50 having a substantially convex surface 60 fits against a matching substantially concave surface 202 disposed within a second center sill, generally designated 200, of an adjacent railway freight car (not shown). It is presently preferred that such substantially convex surface 60 will be convexly shaped in each of a generally lateral direction and a generally vertical direction. A pair of drawbar retainers 70 having a spherical surface 72 are butted against a front lug 204 of the center sill 200. Such spherical surface 72 is fitted against a mating substantially spherical surface portion 62 of the second end of the second member 50, best shown in FIG. 3.

Such second member 50 will preferably include at least one weight-reducing aperture 64, having a predetermined configuration, formed therethrough intermediate its first and second ends.

Those skilled in the art can readily understand that vertical displacement between opposite ends of the adjacent railway freight cars is compensated for in the present invention by the slidable coupling of the pivot pin 14 within the sleeve bushing 58 allowing the second member 50 to move vertically in relationship to the first member 20. Thus the vertically aligning slackless drawbar 10 of the present invention remains in the substantially lateral plane preventing being vertically displaced and, more importantly, minimizing the occurrence of the disengagement of the car body with the bolster in a light railway freight car application.

Lateral movement of the vertically aligning slackless drawbar 10 is enabled by a pivotable coupling of the second member 50 about the pivot pin 14 and further enabled by the convex surface 60 and spherical surfaces 62 to minimize occurrence of a flange climb derailment in light weight freight cars. It will be further understood that the pivotal movement of the second member 50 is limited by the designed clearance 18 in order to minimize the occurrence of jackknifing.

Thus, those skilled in the art can readily understand that the vertically aligning slackless drawbar of the present invention offers a lower cost alternative to a slackless coupler in a light railway freight car application by accommodating longitudinal, vertical and lateral travel directions.

For the sake of brevity, it should be noted that in the most presently preferred embodiment of the instant invention, the longitudinal slack adjustment of the second member is substantially a mirror image of the slack adjustment of the first member of such vertically aligning slackless drawbar 10. Accordingly, a detailed description of such slack adjustment will not be repeated here.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A vertically aligning slackless drawbar for connecting adjacently disposed ends of a pair of railway freight cars together in a substantially semi-permanent manner, said vertically aligning slackless drawbar comprising:

(a) a yoke having a first end and a second end for retainment between a front lug and a rear lug of a first center sill, said yoke having a substantially concave face, a rear portion and a first pair of vertically aligned concentric apertures;

(b) a first member having a first end of a substantially convex surface for mating with said substantially concave face disposed within said yoke, said substantially convex face convexly shaped in each of a generally lateral direction and a generally vertical direction, said first end further having a vertically aligned "F" pin aperture, said first member further having a second end having a cavity formed by a first side surface portion, a second side surface portion, a top surface portion and bottom surface portion, said second end further having a second pair of vertically aligned concentric apertures disposed within said top surface portion and said bottom surface portion of said cavity;

(c) a second member having a first end, said first end having a third tapered surface portion and a fourth tapered surface portion, said first end further having a vertically aligning pivot pin aperture of a predetermined diameter, said second member further having a second end of a substantially convex surface for mating with a substantially concave surface disposed within a second center sill, said substantially convex surface convexly shaped in each of a generally lateral direction and a generally vertical direction, said second end further having a substantially spherical surface portion;

(d) a pivot pin for pivotally coupling said second member to said first member;

(e) a standard type "F" pin for securing said first end of said first member to said yoke;

(f) a pair of drawbar retainers fitted against a front lug of said second center sill, said pair of drawbar retainers having a substantially spherical surface for mating with said substantially spherical surface portion disposed within said second end of said second member;

(g) a pair of gravity wedges for compensating for longitudinal slack; and (h) a pair of at least one leaf spring of a predetermined force and of a predetermined temper disposed between said rear lug and said gravity wedge, said pair of at least one leaf spring for maintaining said pair of gravity wedges in place and preventing said pair of gravity wedges from descending and locking in the draft condition.

2. A vertically aligning slackless drawbar according to claim 1, wherein said vertically aligned "F" pin aperture disposed within said first member includes a pair of wall surfaces tapered toward a center of said first end at a predetermined angle.

3. A vertically aligning slackless drawbar according to claim 1, wherein said first side surface portion and said second side surface portion of said first member are sloped toward a center of said first member at a predetermined angle.

4. A vertically aligning slackless drawbar according to claim 1, further having a pair of sleeve bearings, said pair of sleeve bearings having each bearing disposed within each of said second pair of apertures for minimizing frictional forces during rotation of said pivot pin.

5. A vertically aligning slackless drawbar according to claim 1, wherein said first member includes at least one weight-reducing aperture of a predetermined configuration formed therethrough intermediate said first and said second end of such first member.

6. A vertically aligning slackless drawbar according to claim 1, wherein said second member further includes a sleeve bearing disposed within said pivot pin aperture.

7. A vertically aligning slackless drawbar according to claim 1, wherein said second member includes at least one weight-reducing aperture of a predetermined configuration formed therethrough intermediate said first and said second end of said second member.

8. A vertically aligning slackless drawbar according to claim 1, wherein said rear portion of said yoke includes a first predetermined tapered profile.

9. A vertically aligning slackless drawbar according to claim 1, wherein said gravity wedge includes a second predetermined tapered profile substantially equal to said first predetermined tapered profile of said rear portion of such yoke.

10. A vertically aligning slackless drawbar according to claim 1, wherein a predetermined clearance is formed between said first tapered surface portion and said third tapered surface portion, said predetermined clearance further formed between said second tapered surface portion and said fourth tapered surface portion, said predetermined clearance limiting lateral motion of said second member and jackknifing of said adjacent railway freight cars.

11. A vertically aligning slackless drawbar according to claim 1, wherein said pivot pin enables a vertical movement of said second member in relationship to said first member.

12. A vertically aligning slackless drawbar according to claim 1, wherein said pivot pin enables a lateral movement of said second member in relationship to said first member.

13. A vertically aligning slackless drawbar according to claim 1, wherein said standard type "F" pin is disposed within said vertically aligned "F" pin aperture of said first member, said standard type "F" pin being further disposed within said first pair of vertically aligned concentric apertures of said yoke.

14. A vertically aligning slackless drawbar according to claim 1, wherein said pivot pin is disposed within said pivot pin aperture of said second member, said pivot pin being further disposed within said second pair of vertically aligned concentric apertures of said first member.

15. A vertically aligning slackless drawbar according to claim 1, wherein said second member is coupled to said first member by at least one of threaded fasteners, commercially available shoulder type screws and specialty machined shoulder type screws.

* * * * *